US010183519B1

(12) United States Patent
Landim Batista et al.

(10) Patent No.: US 10,183,519 B1
(45) Date of Patent: Jan. 22, 2019

(54) PAGE BOOKMARKING DEVICE

(71) Applicants: Marcio Almeida Landim Batista, Salvador (BR); Matheus De Araújo Landim Batista, Salvador (BR)

(72) Inventors: Marcio Almeida Landim Batista, Salvador (BR); Matheus De Araújo Landim Batista, Salvador (BR)

( * ) Notice: Subject to any disclaimer, the term of this patent is extended or adjusted under 35 U.S.C. 154(b) by 0 days.

(21) Appl. No.: 15/919,474

(22) Filed: Mar. 13, 2018

(30) Foreign Application Priority Data

Jul. 19, 2017 (BR) ..... 20 2017 015537
Jul. 20, 2017 (BR) ..... 30 2017 003052

(51) Int. Cl.
*B42D 9/00* (2006.01)
*B43K 29/00* (2006.01)
*B43K 21/00* (2006.01)

(52) U.S. Cl.
CPC ..... *B42D 9/001* (2013.01); *B42D 9/00* (2013.01); *B42D 9/004* (2013.01); *B43K 21/006* (2013.01); *B43K 29/00* (2013.01)

(58) Field of Classification Search
CPC ..... B42D 9/00; B42D 9/001; B42D 9/004
USPC ..... 281/42; 116/234
See application file for complete search history.

(56) References Cited

U.S. PATENT DOCUMENTS 1,974,667 A * 9/1934 Solinger ..... B43K 29/00 281/42
3,168,072 A * 2/1965 Nitta ..... B43K 19/14 401/6
4,243,338 A * 1/1981 Williams ..... B43K 29/00 101/195
4,508,464 A * 4/1985 Money ..... B42D 9/007 40/334
4,706,995 A * 11/1987 Dopp ..... B42D 9/007 281/42
6,942,410 B1 * 9/2005 Drewnoski ..... B43K 21/006 401/50
2007/0025800 A1 * 2/2007 Burry ..... B43K 21/006 401/93
2010/0202821 A1 * 8/2010 Regala ..... B42D 9/00 281/42
2011/0109074 A1 * 5/2011 Lee ..... B42D 9/00 281/42
2012/0148331 A1 * 6/2012 Seymour ..... B43K 21/006 401/92

OTHER PUBLICATIONS

GemKlip https://gemklip.com/2016/05/09/pencil-bookmark-the-story/ (Year: 2016).*

* cited by examiner

*Primary Examiner* — Kyle R Grabowski
(74) *Attorney, Agent, or Firm* — Allen, Dyer, Doppelt & Gilchrist, PA

(57) ABSTRACT

The present utility model refers to a page marker device of the type that can be used between the pages of a book or publication, being that the marker incorporates a writing graphite. The device comprises a strip of graphite partially embedded in the elongate body. The recessed portion of the graphite strip has a length greater than the length of the non-embedded part of the graphite strip, and the elongate thin body has a flat part with a surface suitable for printing.

18 Claims, 2 Drawing Sheets

PAGE BOOKMARKING DEVICE

RELATED APPLICATION

This application is based upon prior filed copending Application Nos. BR 20 20017 015537 0 filed Jul. 19, 2017, and BR 30 2017 003052 1 filed Jul. 20, 2017, the entire subject matter of these applications is incorporated herein by reference in its entirety.

FIELD OF INVENTION

The present utility model refers to a device page marker of the type that can be used between the pages of a book or publication, the marker incorporating a graphite of writing.

SUMMARY

The present utility model achieves the above objectives through a page marker device comprising a thin body and a strip of graphite partially embedded in the body, wherein the embedded portion of the graphite strip has a length greater than a length of the non-embedded part of the graphite strip, and the thin body has a flat portion with a surface suitable for print.

The elongate thin body is preferably formed of a sheet of resilient material folded, whereby the folded parts of the sheet of resistant material are joined together and the recessed portion of the strip graphite is embedded between the folded parts of the sheet.

The lateral edge of the elongated thin body may have a recess for finger support.

Preferably, the graphite strip has a rectangular shape with a length of about 2.5 cm, a width of about 0.5 cm and a thickness of about 0.2 cm; the embedded part has a length between about 1.5 cm and about 2.0 cm; and the flat part of the body has a thickness of about 0.1 cm.

DETAILED DESCRIPTION

Fundamentals of the Utility Model

Figure 1:
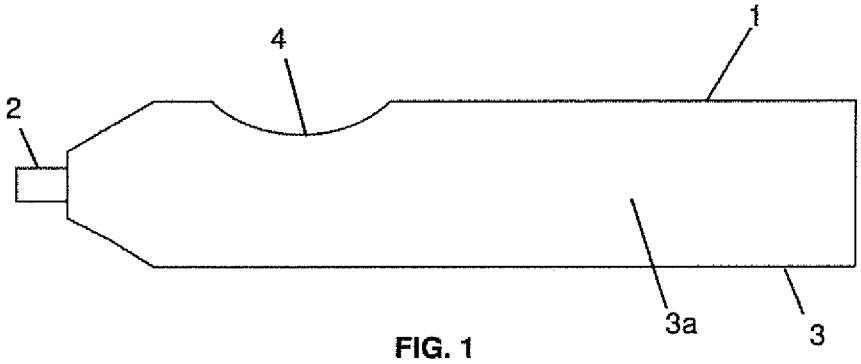
FIG. 1 is a top view of a marker device, according to the present invention.

Book markers are widely used and can be found in various formats and materials. The only requirement is that the user has in relation to the markers is that do not damage the pages of the book or publication in which they are used. Thus, the markers are usually thin and of a material not sharp and does not release paint.

While reading a book or article it is common for the reader to wish writing small notes, or tracing underscores throughout the text. The readers with this habit usually look for a pencil or pen for this end. Many times, the user ends up using his own pencil or pen to mark the book.

Since pencil and pen are instruments with volume, the book marked with the instrument becomes deformed. There are some solutions involving markers with built-in pens. However, such known solutions have some drawbacks.

First of all, the incorporation of the pen requires at least that a portion of the body forms a rigid and robust shell to accommodate and protect the ink load. Thus, the fine character of the marker has just been compromised.

Second, the use of a marker with built-in ink can lead to undesirable accidents, as the ink could leak and damage the pages of the publication. In addition to other undesirable consequences, it should be emphasized that the possibility of leakage makes it impossible for the pen marker to be offered already housed in books for sale, since the ink of the pen would not resist the storage and transportation of books.

Thus, there remains the need for a device that combines a book marker and a writing instrument, but it may be lodged between the pages of the book or publication without volume or deformation of the publication and does not represent any risk of ink leakage or damage to the publication.

Objectives of the Utility Model

The present utility model provides a device page marker that incorporates a graphite for writing, and the can be housed between the pages of a book or publication, without significant increase in volume and without any risk of damage to pages.

Further, the present utility model provides a page marker device that incorporates a graphite for writing that can be stored in books or publications that will be stored or transported for marketing or distribution without risk of leakage. The present utility model also provides a page marker device that incorporates graphite for writing, being that the marker can be easily and comfortably used for written by the reader. The present utility model will be described below based on in FIGS. 1 to 4. The page marker device comprises a body 1 and a strip of graphite 2 partially embedded in the body 1.

The graphite strip 2 preferably has a rectangular shape, with a thickness of up to 3 mm and preferably of 2 mm. Preferably, the graphite used is a graphite of hardness 2B. The body 1 has a thin elongated shape, with a thickness of up to 2 mm and preferably about 1 mm. It is important that the shape and dimensions of the graphite strip 2 ensure that it is strong enough not to damage when the marker device is pressed between the pages of stored or being transported.

Figure 2:
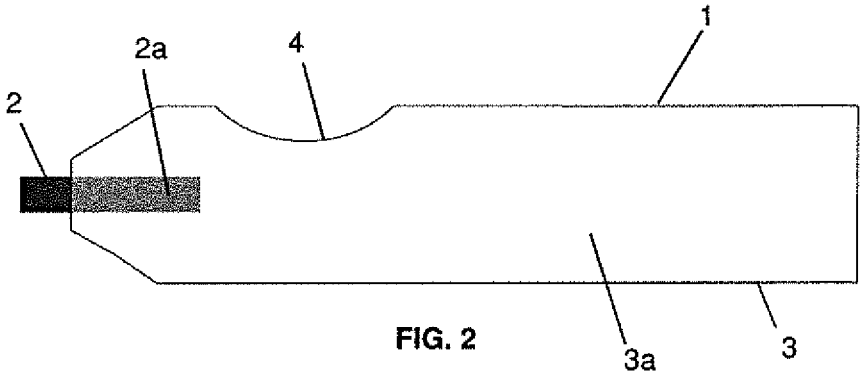
FIG. 2 is a top view of the page marker device, according to the present invention, the showing the part of the graphite strip embedded in the body of the marker device.

As best shown in the schematic view of FIG. 2, the strip of graphite 2 is partially embedded in the body 1 (the recessed portion 2*a* of the strip 2 is shown schematically in FIG. 2). The body 1 may be a formed of a sheet of resilient material folded, the folded parts are joined by adhesive or similar medium. Preferably, the body is formed from a sheet of paper panamá of 0.5 mm, so that the body stays with the thickness of 1 mm. Thus, the graphite strip 2 may be partially inserted between the parts folded portions of the body 1, so that the folded portions of the body 1 engage the recessed portion 2*a* of the graphite strip 2.

Figure 3:
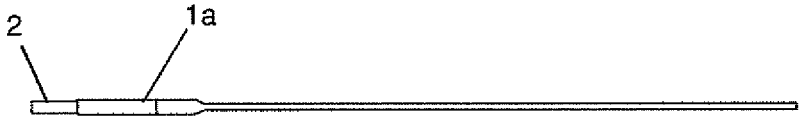
FIG. 3 is a side view of the page marker device, according to the present invention.

The side view of FIG. 3 shows how the body 1 assumes a thicker configuration 1*a* in the portion where the part 2*a* of the graphite strip is embedded. Preferably, the rectangular graphite strip 2 has a length of approximately 2.5 cm and a width of about 0.5 cm. In order to ensure that the graphite strip 2 will be protected by the body 1, but accessible for comfortable writing, the part 2*a* of the strip 2 embedded in the body 1 has a length of between about 1.5 cm and 2.0 cm and, preferably 1.8 cm. Thus, the recess portion 2*a* has a longer than the non-recessed portion of strip 2.

As previously mentioned, the recessed portion 2*a* is important for the graphite strip to be secured to the body and pressure or force exerted on it. The embedded part 2*a* is fixed to the body, preferably by means of gluing the sheets that form the body. Preferably, the body 1 has a length of about of 11 cm in its longest part and a width of approximately 2.5 cm in its widest part. As shown in the figures, the body 1 has a flat portion 3 with a surface 3*a* suitable for printing. This surface can be used to receive images printed with messages or ads commercials, QR codes or any desired print. Preferably the printing surface 3*a* has a rectangular area of about 16 $cm^2$.

Preferably, the body 1 further has, in one of its side edges, a recess 4 that functions to support during writing. This recess, which can take the form of recess, enhances the usability of the device, allowing a better handle on the marker arrangement and a greater comfort for writing. As shown in the figures, the body portion 1 may have a lateral taper in the region where the graphite strip 2 is embedded. This bottleneck also provides better usability, since that the body does not interfere during positioning of the tip of the strip near the writing surface.

Figure 4:
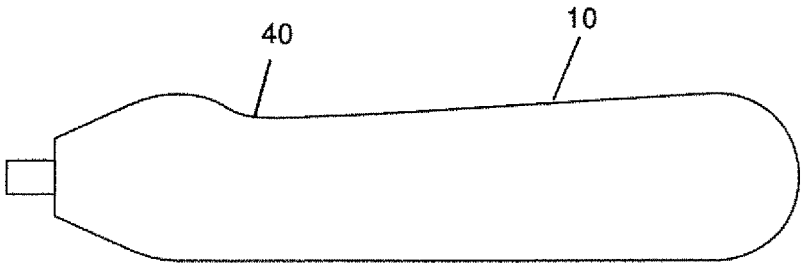
FIG. 4 is a top view of another embodiment of the top of the page marker device, according to the present invention.

FIG. 4 shows a constructive variant of the device where the body 10 has rounded contours and where the finger rest recess 40 has a slightly bulged shape. As is clear from the above description and the figures, the device marker of this utility model allows the user can take notes at the time of reading your publication, so that practical and fast, without risk of damaging the publication in addition, due to its construction, the marker device can be placed between the pages of a publication in storage, transport or display, without any risk of damage to the publication even if forces and pressures are exerted on the publication. Finally, by having simple and practical construction, the device proposed marker presents low cost, being an economical solution for print advertising on the printing surface of your body.

Examples of two variants of the present invention have been described, model of utility, it should be understood that the scope of this model other possible constructive variants, limited only by the content of the appended claims, including possible equivalents.

The invention claimed is:

1. A page bookmark device comprising:

an elongate body comprising first and second sheets; and a graphite strip having a recessed portion embedded in the elongate body, and a free portion extending longitudinally outward from said elongate body; said graphite strip being embedded between said first and second sheets said recessed portion having a length greater than a length of said free portion;

said elongate body having a flat part with a surface suitable for printing; said flat part having a thickness of about 0.1 cm;

said graphite strip being rectangle-shaped and having opposing flat major surfaces;

said free portion of said graphite strip having a rectangle-shaped distal end.

2. The page bookmark device according to claim 1 wherein said elongate body has first and second opposing longitudinal sides, the first opposing longitudinal side defining a recess for supporting of a finger.

3. The page bookmark device according to claim 2 wherein said the recess comprises a curved recess.

4. The page bookmark device according to claim 2 wherein said the recess comprises a curved portion, and a straight portion extending from said curved portion.

5. The page bookmark device according to claim 1 wherein said graphite strip has a length of 2.5 cm; wherein said graphite strip has a width of about 0.5 cm; wherein said graphite strip has a thickness of about 0.2 cm; and wherein said recessed portion has a length between 1.5 cm and 2.0 cm.

6. The page bookmark device according to claim 1 wherein said recessed portion of said graphite strip has length less than 20% of a length of said elongate body.

7. The page bookmark device according to claim 1 wherein said elongate body has opposing first and second ends, the first end comprising tapered sides, the second end having parallel sides.

8. The page bookmark device according to claim 1 wherein said elongate body has opposing first and second ends, the first end comprising tapered sides, the end second end having curved sides.

9. The page bookmark device according to claim 1 wherein the flat part has a thickness of 0.1 cm.

10. The page bookmark device according to claim 1 wherein said elongate body has first and second opposing longitudinal sides, the first opposing longitudinal side defining a recess for supporting of a finger.

11. The page bookmark device according to claim 10 wherein said the recess comprises a curved recess.

12. The page bookmark device according to claim 10 wherein said the recess comprises a curved portion, and a straight portion extending from said curved portion.

13. A page bookmark device comprising:

an elongate body comprising first and second sheets; and a graphite strip having a recessed portion embedded in the elongate body, and a free portion extending longitudinally outward from said elongate body; said graphite strip being embedded between said first and second sheets said recessed portion having a length greater than a length of said free portion;

said elongate body having a flat part with a surface suitable for printing; said flat part having a thickness of about 0.1 cm;

said graphite strip being rectangle-shaped and having opposing flat major surfaces;

said free portion of said graphite strip having a rectangle-shaped distal end;

said elongate body having first and second opposing longitudinal sides, and opposing first and second ends, the first end comprising tapered sides, the second end having parallel sides, the first opposing longitudinal side defining a curved recess.

14. The page bookmark device according to claim 13 wherein said elongate body comprises first and second sheets;

and wherein said graphite strip is embedded between said first and second sheets.

15. The page bookmark device according to claim 13 wherein said graphite strip has a length of 2.5 cm; wherein said graphite strip has a width of about 0.5 cm; wherein said graphite strip has a thickness of about 0.2 cm; and wherein said recessed portion has a length between 1.5 cm and 2.0 cm.

16. The page bookmark device according to claim 13 wherein said recessed portion of said graphite strip has length less than 20% of a length of said elongate body.

17. The page bookmark device according to claim 1 wherein the flat part has a thickness of 0.1 cm.

18. A page bookmark device comprising: an elongate body constitutes first and second sheets; and a graphite strip having a recessed portion embedded in the elongate body, and a free portion extending longitudinally outward from said elongate body, said graphite strip being embedded between said first and second sheets; said recessed portion having a length greater than a length of said free portion; said elongate body having a flat part with a surface suitable for printing; said graphite strip being rectangle-shaped and having opposing flat major surfaces; said free portion of said graphite strip having a rectangle-shaped distal end.

* * * * *